US005146756A

United States Patent [19]

Lavin

[11] Patent Number: 5,146,756

[45] Date of Patent: Sep. 15, 1992

[54] AIR SEPARATION

[75] Inventor: John T. Lavin, Guildford, England

[73] Assignee: The BOC Group plc, Surrey, England

[21] Appl. No.: 728,435

[22] Filed: Jul. 11, 1991

[30] Foreign Application Priority Data

Jul. 12, 1990 [GB] United Kingdom ..... 9015377

[51] Int. Cl.[5] ..... F25J 3/02

[52] U.S. Cl. ..... 62/24; 62/39

[58] Field of Search ..... 62/24, 38, 39

[56] References Cited

U.S. PATENT DOCUMENTS

| | | | |
|---|---|---|---|
| 4,222,756 | 9/1960 | Thorogood | 62/38 |
| 4,367,082 | 1/1983 | Tomisaka et al. | 62/13 |
| 4,372,764 | 2/1983 | Theobald | 62/13 |
| 4,790,866 | 12/1988 | Rathbone | 62/24 |

*Primary Examiner*—Ronald C. Capossela
*Attorney, Agent, or Firm*—Larry R. Cassett; David M. Rosenblum

[57] ABSTRACT

An air stream is compressed in a compressor, and purified in an apparatus. A major portion of the compressed, purified air stream is then cooled in a main heat exchanger to a temperature suitable for its separation in a double rectification column comprising a higher pressure column and a lower pressure column. The lower pressure column typically operates at a pressure in the range of 2.5 to 4.5 bar. A minor portion of the compressed, purified air stream is employed to generate refrigeration for the air separation by being further compressed in the compressor and expanded in a turbine. Oxygen and nitrogen product streams are withdrawn from the lower pressure column. The nitrogen product stream is passed through the main heat exchanger countercurrently to the major air stream. A part of this nitrogen stream is withdrawn at an intermediate region of the heat exchanger and is expanded in an expansion turbine. The resulting expanded nitrogen passes through the heat exchanger from its cold to its warm end thereby creating additional refrigeration so as to maintain a mean temperature different from end to end of the heat exchanger of at least 10K between the streams being warmed and the streams being cooled. A substantial reduction in the size of the heat exchanger compared with that of a conventional plant thereby becomes possible. The expanded nitrogen stream leaving the warm end of the heat exchanger may also be used to perform a cooling duty at about ambient temperature.

8 Claims, 1 Drawing Sheet

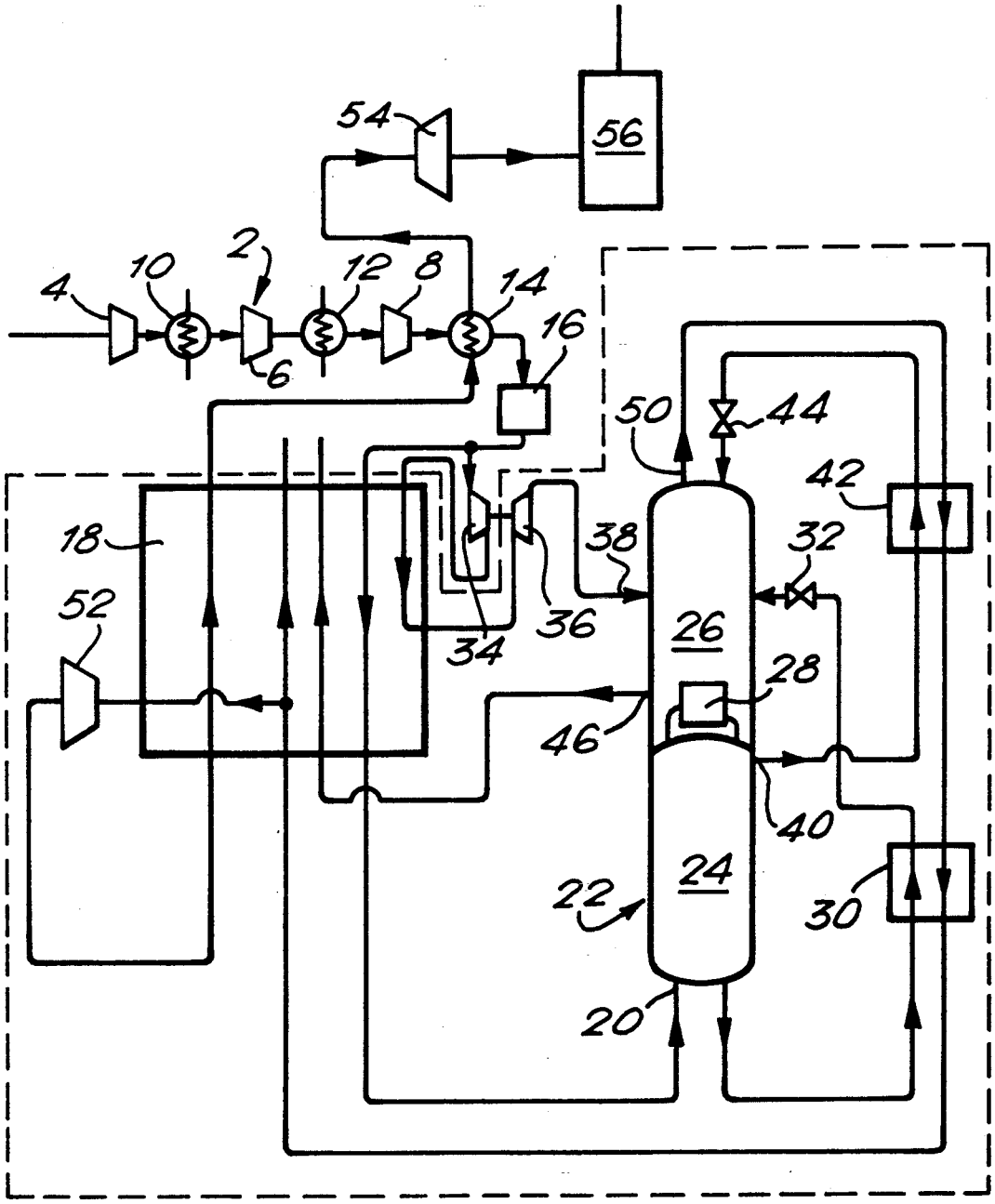
54
56
2
4
10
12
8
14
16
6
50
44
42
18
38
32
52
34
36
26
28
46
40
24
22
30
20

AIR SEPARATION

BACKGROUND

This invention relates to air separation.

Modern industry and chemical processes including an oxidation step call for ever larger quantities of oxygen in order to perform that step. Oxygen can be produced in quantities in excess of 2000 tons per day by an air separation process which comprises compressing an air stream, purifying the air stream by removing therefrom components of relatively low volatility such as water vapour and carbon dioxide, cooling the thus purified air stream to a temperature suitable for its separation by fractional distillation or rectification, and then performing that separation so as to produce an oxygen product of desired purity. The purification is preferably performed by using beds of adsorbent which adsorb the components of low volatility such as water vapour and carbon dioxide. The fractionation of the air is preferably performed in a double column comprising a higher pressure column and a lower pressure column which share a heat exchanger that condenses nitrogen at the top of the higher pressure column and reboils oxygen-rich liquid at the bottom of the lower pressure column. Some of the thus formed liquid nitrogen is used as reflux in the higher pressure column while the remainder is removed from the higher pressure column, is subcooled, and is passed through an expansion valve into the top of the lower pressure column so as to provide reflux for that column. The air is introduced into the high pressure column. Oxygen-enriched liquid air is withdrawn from the bottom of the high pressure column and is passed to the lower pressure column where it is typically separated into substantially pure oxygen and nitrogen products. These products may be withdrawn from the lower pressure column in the gaseous state and warmed to ambient temperature in countercurrent heat exchange with the incoming air, thereby effecting the cooling of the incoming air. Since the process operates at cryogenic temperatures, refrigeration has to be generated. This is typically done either by expanding a part of the incoming air in a turbine or by taking a stream of nitrogen from the high pressure column and passing it through an expansion turbine.

Such air separation plants are nowadays very common. Almost universally, the lower pressure column operates at 1.3 to 1.7 bar and the higher pressure column at pressures in the range 5.5 to 6.5 bar. The reason for choosing these operating pressures is that it enables product nitrogen and oxygen streams, after being warmed to ambient temperature, to be at a pressure a little above atmospheric.

In practice, mechanical engineering and transport constraints place an upper limit on the size of such an air separation plant when the columns are to be fabricated remote from the intended site of the air separation plant. Expressed in terms of the tonnage of oxygen produced per day from the plant, this limit is in the order of 2,500 tons per day. Thus, the so-called Sasol process for the production of oil from coal, since it has a demand for oxygen well in excess of 5,000 tons per day, uses several separate air separation plants to fulfil the oxygen demand.

It has been proposed to operate the higher pressure and lower pressure columns at pressures substantially in excess of the conventional ranges of 5.5 to 6.5 and 1.3 to 1.7 bar respectively. The prime reason for using such higher pressures is to obtain more efficient separation in the low pressure column. A disadvantage of such proposals is that when there is insufficient demand for all the nitrogen that is produced, there is a problem of what to do with the resulting higher pressure product nitrogen stream. It has been proposed to solve this problem by recovering energy from the nitrogen stream by expanding it in a turbine and to use this energy in generating electricity for export. Such proposals are indeed generally advantageous. There are some locations, however, where the export of electricity is not possible or desirable. The invention relates to an alternative method and apparatus for taking advantage of the nitrogen product.

SUMMARY OF THE INVENTION

According to the present invention there is provided a method of separating air comprising reducing the temperature of the compressed air stream by heat exchange in at least one main heat exchanger to a temperature suitable for its separation by rectification, rectifying the air in a double rectification column, withdrawing an oxygen stream and a nitrogen stream from the lower pressure column of the double rectification column, and passing the oxygen and nitrogen streams through the main heat exchanger in countercurrent heat exchange relationship with the air stream, wherein the lower pressure rectification column is operated at a pressure of at least 2 bar and at least part of the nitrogen stream is expanded in a turbine and passed through the main heat exchanger countercurrently to the air stream so as to create refrigeration and maintain a mean temperature difference of at least 10K between the expanded nitrogen and the air stream being cooled in the main heat exchanger.

The invention also provides apparatus for separating air including at least one main heat exchanger for reducing the temperature of a compressed air stream to a value suitable for its separation by rectification, a double rectification column having an inlet for air in communication with a passage for an air stream extending through said main heat exchanger and outlets from the lower pressure column of the double rectification column for an oxygen stream and a nitrogen stream, said outlets communicating with passages through the main heat exchanger, and an expansion turbine for expanding at least a part of the nitrogen stream and returning at through the said main heat exchanger countercurrently to the compressed air stream, the turbine being arranged such that there is able to be maintained a mean temperature difference of at least 10K between the nitrogen stream and the air stream being cooled in use of the apparatus.

Preferably, at least part of the nitrogen stream is used to perform a cooling duty outside an insulated housing in which the rectification column and the main heat exchanger are located. The cooling duty to be performed outside the insulated housing may for example be the removal of the heat of compression from a compressed air stream, the cooling of water used to perform a cooling duty on the site of the air separation apparatus, or the condensation of at least one component of a gas mixture produced on the site of the air separation apparatus.

Preferably, the said temperature difference is at least 20K.

It is conventional in the art of air separation to try to maintain small temperature differences between streams being warmed and streams being cooled in the heat exchangers thereof. Such a practice leads to more efficient energy utilisation but requires larger heat exchangers. By using a large temperature difference between the streams being warmed and the streams being cooled, the main heat exchanger may be made relatively small. In particular, if the main heat exchanger is of the matrix kind, it may be made with fewer blocks, thereby reducing the requirement for manifolds and pipes and other ancillary equipment. Not only does this result in a capital saving on the main heat exchanger itself, there is also a reduction in the size of the insulated housing (sometimes referred to as the "cold box") in which the parts of the air separation apparatus that operate cryogenic temperatures are located. Moreover, the nitrogen stream itself leaves the main heat exchanger at a lower temperature facilitating its use for cooling duties outside the cold box.

Furthermore, by operating the lower pressure rectification column at a pressure of at least 2 bar (and preferably a pressure in the range 2.5 to 4.5 bar) it becomes possible to produce oxygen at a greater rate from a double rectification column of given size.

Using the nitrogen stream to remove heat of compression from a compressed air stream helps to reduce the requirements for cooling water of the air separation apparatus and may therefore make possible a reduction in the size of cooling towers used to produce such cooling water to the air separation and other apparatus.

The nitrogen stream may also be used to cool the water in a cooling tower directly. This use of the nitrogen makes possible a reduction in the size of mechanical refrigeration equipment used to cool water, or to its elimination altogether. In addition, it may be possible to reduce the temperature to which the water is cooled in comparison with conventional plant, thereby making it a more efficient coolant and hence making possible a reduction in the size of the installation needed to cool the water. Preferably, the cooling of the water is effected by passing the nitrogen directly into contact with the water.

BRIEF DESCRIPTION OF THE DRAWING

The method and apparatus according to the present invention is now described by way of example with reference to the accompanying drawing which is a schematic diagram of an air separation plant.

DETAILED DESCRIPTION

Referring to the drawing, the illustrated apparatus includes a plural stage compressor 2 having compression stages 4, 6 and 8 immediately downstream of which are respectively after coolers 10, 12 and 14. The after coolers 10 and 12 are water cooled. A stream of air is compressed in the compressor 2 to a pressure of about 11 bar. The air is then passed through a purification apparatus 16 effective to remove low volatility impurities, principally water vapour and carbon dioxide, from the incoming air. The apparatus 16 is of the kind which employs beds of adsorbent to adsorb the water vapour and carbon dioxide from the incoming air. The beds may be operated out of sequence with one another such that while one or more beds are being used to purify the air, the remaining bed or beds are being regenerated, typically by means of a stream of nitrogen. The purified air stream is then divided into major and minor streams.

The major stream passes through a main heat exchanger 18 in which its temperature is reduced to a level suitable for separation of the air by rectification at cryogenic temperatures.

As shown in the drawing, the main heat exchanger 18 is a single piece of equipment. It is however possible to employ a plurality of main heat exchangers in a series or in parallel with one another or in a combination of both series and parallel arrangements. The major air stream is cooled in the main heat exchanger 18 typically to its saturation temperature at the prevailing pressure and thus leaves the cold end of the heat exchanger 18 at this temperature. The major air stream is then introduced through an inlet 20 into a higher pressure rectification column 24 forming part of a double rectification column 22. By the term "double rectification column" as used herein is meant an apparatus comprising two rectification columns, one operating at a higher pressure than the other, and a condenser-reboiler which condenses nitrogen vapour from a higher pressure rectification column and reboils an oxygen-rich liquid fraction of the lower pressure column. Thus, in the drawing, there is also shown above the column 24 a lower pressure rectification column 26. Both rectification columns 24 and 26 contain liquid-vapour contact trays and associated downcomers (or other means) (not shown) whereby a descending liquid phase is brought into intimate contact with an ascending vapour phase such that mass transfer occurs between the two phases. In each column, the descending liquid phase becomes progressively richer in oxygen and the ascending vapour phase progressively richer in nitrogen. The higher pressure column 24 operates at a pressure a little below that to which incoming air is compressed. The column 24 is preferably operated so as to give a substantially pure nitrogen fraction at its top but an oxygen fraction at its bottom which still contains an appreciable proportion of nitrogen.

The columns 24 and 26 are linked together by a condenser-reboiler 28. The condenser-reboiler 28 receives nitrogen vapour from the top of the higher pressure column 24 and condenses it by heat exchange with boiling liquid oxygen in the column 26. The resulting condensate is returned to the higher pressure column 24. Part of the condensate provides reflux for the column 24 while the remainder is collected, and a stream of it is withdrawn through outlet 40, is sub-cooled in a heat exchanger 42 and passed into the top of the lower pressure column 26 through an expansion valve 44 and thereby provides reflux for the lower pressure column 26.

The lower pressure rectification column 26 operates at a pressure in the order of 3.3 bar and receives an oxygen-nitrogen mixture for separation from two sources. The first source is the minor air stream performed by dividing the stream of air leaving the purification apparatus 16. The minor air stream is compressed in a booster compressor 34 (typically to a pressure in the order of 20 bar), is then passed through the main heat exchanger 18 cocurrently with the major air stream from the warm end of the heat exchanger 18 to an intermediate position thereof, is withdrawn from the intermediate position thereof at a temperature in the order of 200K, and is then expanded in an expansion turbine 36 to the operating pressure of the lower pressure rectification column 26. The expanded minor air stream is then introduced into the column 26 through an inlet 38. The expansion turbine 36 may be coupled to the booster-compressor 34 so as to drive the compressor 34, thereby making it unnecessary to provide external power for that purpose. Alternatively, however, the two machines may be independent of one another. This independent arrangement is often preferred since it enables the outlet pressure of each machine to be set independently of the other.

The second source of oxygen-nitrogen mixture for separation in the lower pressure rectification column 26 is a liquid stream of oxygen-enriched fraction taken from the bottom of the higher pressure column 24. This stream is sub-cooled in a heat exchanger 30 and is then passed through a Joule-Thomson valve 32 and flows into the column 26.

A product oxygen stream is withdrawn from the lower pressure column 26 through an outlet 46 and is warmed to near ambient temperature by passage through the main heat exchanger 18 countercurrently to the incoming air stream. In addition, a product nitrogen stream is withdrawn from the top of the lower pressure rectification column 26 through an outlet 50 and first passes through the heat exchanger 42 countercurrently to the liquid nitrogen stream being sub-cooled therein. The nitrogen stream then flows through the heat exchanger 30 in countercurrent heat exchange relationship with the oxygen-rich liquid being cooled therein. The nitrogen is further warmed by its passage through the heat exchanger 30. It then flows into the cold end of the main heat exchanger 18 and passes a part of the way through this heat exchanger. The nitrogen stream is then divided. A part of it is withdrawn from the main heat exchanger (for example at a temperature in the order of 130K) and is expanded in an expansion turbine 52 to a pressure a little bit in excess of atmospheric pressure. The temperature of the nitrogen stream on leaving the expansion turbine 52 is typically in the order of 10K below that at which the major stream of air leaves the heat exchanger 18. The temperature difference preferably widens in the direction of the warm end of the heat exchanger 18 such that at the warm end the temperature difference is in the order of 20K and the mean temperature difference between the two streams over the length of the heat exchangers is more than 10K. Thus expanded nitrogen stream is then returned through the heat exchanger from its cold end to its warm end and is thereby able to maintain a substantial mean temperature difference between it and the major air stream being warmed. On leaving the warm end of the main heat exchanger 18 the expanded nitrogen stream may be employed in the regeneration of the purification apparatus 16.

That part of the nitrogen stream which is not taken from the main heat exchanger 18 for expansion in the turbine 52 continues its flow through the heat exchanger 18 countercurrently to the major air stream. It typically leaves the warm end of the main heat exchanger 18 at temperature some 10 to 20K below ambient. This nitrogen is particularly suitable for use or a cooling or refrigeration duty outside those parts of the plant which operate at cryogenic temperatures. For example, as shown in the drawing, the stream may be used to provide cooling for one of the after coolers 10, 12 and 14. As shown in the drawing, it is the after cooler 14 which is cooled by the nitrogen. The resulting warmed nitrogen is then reduced in pressure, for example, in an expansion turbine 54 so as to reduce its temperature again to below ambient, and is passed into a cooling tower 56 which is used to provide cooling for machinery on other parts of the site where the air separation plant is located. Thus, the expanded nitrogen from the turbine 54 may be introduced directly into the water in the cooling tower 56. This procedure causes evaporative cooling of the water such that its temperature may be reduced to about 5° C. By using nitrogen to provide cooling for the compressor 2, the demands for cooling water are reduced thus making possible a reduction in the size of the cooling tower 56. Moreover, by using nitrogen to cool the water, further reductions in size and in the need to employ ancillary refrigeration equipment employing Freon or other refrigerants is made possible. In one example, the expansion in the turbine 54 may be used to reduce the temperature of the nitrogen from about 350K to about 285K.

By using the expansion turbine 52 to maintain a large temperature difference between the streams being cooled and the streams being warmed in the main heat exchanger, its size may be smaller than is conventional for a plant of a given rate of production of oxygen. Moreover, by operating the low pressure column at a pressure in the order of 3 bar, it becomes we believe possible to provide more than 3,000 tons per day of oxygen from plants having columns of a size that permit their fabrication at remote sites. If there is a particularly large demand for oxygen say in the order of 10,000 tons per day, it becomes possible to meet that demand using three plants instead of four. When the additional savings made possible in the cost of fabricating heat exchangers are taken into account, very substantial cost reductions can therefore be achieved. Moreover, since the main heat exchanger 18 is made smaller, there is a concomitant reduction in the size of a cold box or insulated housing in which the parts of the plant that operate cryogenic temperatures are located, making possible a yet further saving in capital cost. (The housing is shown schematically by the dotted lines in the drawing.) Although by maintaining relatively large temperature differences between the streams being cooled and the streams being warmed in the main heat exchanger 18, the power consumption of the plant is increased, this is a less significant factor on sites where there are large natural resources of energy but which are remote from major industrial centres such that export of the energy becomes uneconomic. Examples of such sites are natural gas fields in remote locations.

Various changes in modifications can be made to the plant shown in the drawing. The use of the expanded nitrogen stream to provide cooling for the cooling tower and one of the after coolers of the compressor 2 are but mere examples of uses of the cooling capacity of the nitrogen that can be made at about ambient temperature rather than at cryogenic temperatures.

It is additionally preferred to use a small subsidiary stream (not shown) of the nitrogen leaving the warm end of the heat exchanger 18 to remove heat from the adsorbent beds of the purification apparatus 16 as part of their regeneration. This subsidiary stream may then be recombined with the main nitrogen stream intermediate the heat exchanger 14 and the turbine 54 or intermediate the turbine 54 and the cooling tower 56.

If desired, the compressor 34 and turbine 36 may be omitted and all the air is then passed to the column 24. The refrigeration requirements for the air separation process may then be met by the nitrogen turbine 52. Alternatively, and more preferably, two nitrogen turbines may be employed in parallel to one another. One may have an outlet temperature in the range of, say, 90 to 100K, and the other may have an outlet temperature in the range of, say, 140 to 150K. By using such an arrangement, it becomes possible to employ being warmed, a relatively small temperature difference (say, in the range 5 to 10K), between the air stream being cooled and the nitrogen stream from the cold end of the heat exchanger 18 to the position of the introduction of the nitrogen from the turbine with the higher temperature outlet, and a relatively large such temperature difference (say, at least 20K) from that position to the warm end of the heat exchanger 18.

Some of the nitrogen may also be used to perform a refrigeration duty at below ambient temperature. Thus, referring to the drawing, a part of the nitrogen stream taken from the heat exchanger 18 for expansion in the turbine 52 may be used to provide cooling for a heat exchanger (not shown) or other device (not shown) in which at least one component of a gaseous mixture is condensed. Such a nitrogen stream is preferably taken from upstream of the turbine 52, but may be taken from downstream thereof.

It is also possible to modify the apparatus shown in FIG. 1 by using a valve or valves rather than the expansion turbine 54 to reduce the pressure of the nitrogen prior to its introduction into the cooling tower 56.

I claim:

1. A method of separating air, comprising: reducing the temperature of the compressed air stream by heat exchange in at least one main heat exchanger to a temperature suitable for its separation by rectification; rectifying the air in a double rectification column; withdrawing an oxygen stream and a nitrogen stream from the lower pressure column of the double rectification column, and passing the oxygen and nitrogen streams through the main heat exchanger in countercurrent heat exchange relationship with the air stream; wherein the lower pressure rectification column is operated at a pressure of at least 2 bar and at least part of the nitrogen stream is expanded in a turbine and passed through the main heat exchanger countercurrently to the air stream so as to create refrigeration and maintain a mean temperature difference of at least 10K between the expanded nitrogen and the air stream being cooled in the main heat exchanger.

2. The method as claimed in claim 1, in which the said mean temperature difference is at least 20K.

3. The method as claimed in claim 1 or claim 2, in which at least part of the nitrogen stream is used to perform a cooling duty outside an insulated housing in which the rectification column and the main heat exchanger are located.

4. The method as claimed in claim 3, in which the cooling duty to be performed outside the insulated housing is the removal of the heat of compression from a compressed air stream.

5. The method as claimed in claim 3 in which the said cooling duty outside the insulated housing is the cooling of water.

6. The method as claimed in claim 5, in which the water is held in a cooling tower.

7. An apparatus for separating air including: at least one main heat exchanger for reducing the temperature of a compressed air stream to a value suitable for its separation by rectification; a double rectification column having an inlet for air in communication with a passage for an air stream extending through said main heat exchanger and outlets from the lower pressure column of the double rectification column for an oxygen stream and a nitrogen stream; said outlets communicating with passages through the main heat exchanger; and an expansion turbine for expanding at least a part of the nitrogen stream and returning it through the said main heat exchanger countercurrently to the compressed air stream; the turbine being arranged such that there is able to be maintained a mean temperature difference of at least 10K between the expanded nitrogen stream and the air stream being cooled in use of the apparatus.

8. The apparatus as claimed in claim 7, additionally including means for employing at least part of the nitrogen stream to perform to cooling duty outside an insulated housing in which the main heat exchanger and the double rectification column are located.

* * * * *